US009619948B2

(12) United States Patent
DeVore

(10) Patent No.: US 9,619,948 B2
(45) Date of Patent: Apr. 11, 2017

(54) SYSTEM AND METHOD FOR MONITORING AN EARTH-MOVING OPERATION OF A MACHINE

(71) Applicant: Caterpillar Inc., Peoria, IL (US)

(72) Inventor: James H. DeVore, Metamora, IL (US)

(73) Assignee: Caterpillar Inc., Peoria, IL (US)

( * ) Notice: Subject to any disclaimer, the term of this patent is extended or adjusted under 35 U.S.C. 154(b) by 0 days.

(21) Appl. No.: 14/819,568

(22) Filed: Aug. 6, 2015

(65) Prior Publication Data

US 2017/0039786 A1 Feb. 9, 2017

(51) Int. Cl.
*G07C 5/08* (2006.01)

(52) U.S. Cl.
CPC ..... *G07C 5/0816* (2013.01); *G07C 5/0808* (2013.01)

(58) Field of Classification Search
CPC ..... G07C 5/08; G07C 5/0808; G07C 5/0816
USPC ..... 701/123
See application file for complete search history.

(56) References Cited

U.S. PATENT DOCUMENTS 6,092,021 A * 7/2000 Ehlbeck ..... G01L 3/26 701/123
6,484,088 B1 * 11/2002 Reimer ..... G01F 23/296 340/450.2
8,364,440 B2 * 1/2013 Putkonen ..... G06Q 10/06 702/179
8,457,848 B2 6/2013 Eastman et al.
8,494,754 B2 * 7/2013 Fukumoto ..... F02D 11/105 701/103
8,977,444 B2 3/2015 Fukuhara et al.
2002/0133288 A1 * 9/2002 Minami ..... G01F 9/02 701/114
2006/0287841 A1 * 12/2006 Hoshi ..... E02F 9/26 702/182
2007/0219683 A1 * 9/2007 Daum ..... B61L 3/006 701/19
2011/0054768 A1 * 3/2011 Sullivan ..... B60W 10/06 701/123
2011/0160990 A1 * 6/2011 Mineta ..... G01C 21/3469 701/123
2011/0295423 A1 12/2011 Anderson
2012/0095920 A1 * 4/2012 McQuade ..... H04L 9/3215 705/50
2013/0046449 A1 * 2/2013 Yucel ..... F16H 61/0213 701/51
2013/0268138 A1 10/2013 Moughler et al.
(Continued)

FOREIGN PATENT DOCUMENTS

KR 20130138463 12/2013

*Primary Examiner* — Atul Trivedi
(74) *Attorney, Agent, or Firm* — James S. Bennin

(57) ABSTRACT

A computer-implemented method for monitoring an operation performed by a machine having an implement is provided. The method includes determining a fuel consumption rate value of the machine. The method also includes generating a provisional value based at least in part on the fuel consumption rate value for the operation. The method further includes determining one or more thresholds for the operation. The one or more thresholds correspond to a normal fuel consumption rate value of the machine for the operation. The method further includes generating a status indicator, indicative of a score of the operation based at least in part on a comparison of the provisional value and the one or more thresholds.

20 Claims, 8 Drawing Sheets

(56) References Cited

U.S. PATENT DOCUMENTS

| | | | | |
|---|---|---|---|---|
| 2014/0058635 | A1* | 2/2014 | Furukawa | B60R 16/02 701/50 |
| 2014/0195046 | A1* | 7/2014 | Fadler | H04L 9/3215 700/237 |
| 2014/0277905 | A1* | 9/2014 | Anderson | G07C 5/08 701/29.3 |
| 2014/0279535 | A1* | 9/2014 | Fadler | G06Q 20/40 705/44 |
| 2015/0058062 | A1* | 2/2015 | Mejegard | G06Q 10/06 705/7.22 |
| 2015/0073692 | A1* | 3/2015 | Malikopoulos | B60W 50/14 701/123 |
| 2015/0101519 | A1 | 4/2015 | Blackwell et al. | |

* cited by examiner

SYSTEM AND METHOD FOR MONITORING AN EARTH-MOVING OPERATION OF A MACHINE

TECHNICAL FIELD

The present disclosure relates generally to a system and a method for monitoring an operation performed by a machine, and more particularly relates to a system and a method for monitoring suboptimal conditions of an operation performed by a machine.

BACKGROUND

Machines such as track-type tractors, dozers, motor graders and wheel loaders are used to perform a variety of tasks, including, for example, moving material and/or altering work surfaces at a worksite. In general, these machines may function in accordance with a work plan for a given worksite to perform operations, including digging, loosening, carrying, and any other manipulation of material within a worksite. Furthermore, the work plan may often involve predetermined repetitive tasks that may be entirely or at least partially automated to minimize operator involvement and promote efficiency. A given work environment may involve autonomous and/or semi-autonomous machines that perform tasks in response to preprogrammed commands or delivered commands.

In automated work environments, it is especially desirable to ensure that the machines perform work operations in an efficient and productive manner in accordance with the given work plan. Seemingly minor deviations from the work plan, if undetected or left unaddressed, may be compounded into more significant and obvious errors in the eventual work product. Therefore, early detection of deviations in the work progress or suboptimal machine settings can play an important role in ensuring efficient and productive passes, such as by requesting earlier operator intervention and correction to compensate for the errors. However, in the context of automated work environments, remotely monitoring multiple groups of different machines with a limited number of operators can be challenging.

US Patent Publication No. 2011/0295423 discloses an autonomous machine management system. The autonomous machine management system includes a number of autonomous machines configured to perform area coverage tasks in a worksite and a number of worksite areas within the worksite. A conditional behavior module is provided to be executed by a processor unit and configured to determine whether a number of conditions are met for the number of worksite areas. A navigation system is configured to operate the autonomous machines to perform the area coverage tasks and move between the number of worksite areas when the number of conditions is met.

The above reference provides system and method for controlling operations of a number of autonomous machines in a worksite. However, the reference may not provide sufficient means for monitoring suboptimal conditions of the operations being performed by the autonomous machines.

SUMMARY OF THE DISCLOSURE

In one embodiment of the present disclosure, a computer-implemented method for monitoring an operation performed by a machine having an implement is provided. The method includes determining a fuel consumption rate value of the machine. The method also includes generating a provisional value based at least in part on the fuel consumption rate value for the operation. The method further includes determining one or more thresholds for the operation. The one or more thresholds correspond to a normal fuel consumption rate value of the machine for the operation. The method further includes generating a status indicator, indicative of a score of the operation based at least in part on a comparison of the provisional value and the one or more thresholds.

In another embodiment of the present disclosure, a control system for monitoring an operation performed by a machine having an implement is provided. The control system includes a communication device configured to receive the fuel consumption rate value of the machine. The control system also includes a memory configured to store the fuel consumption rate value. The control system further includes a controller in communication with the memory. The controller is configured to generate the provisional value based at least in part on the fuel consumption rate value for the operation. The controller is further configured to determine one or more thresholds for the operation. The one or more thresholds correspond to the normal fuel consumption rate value of the machine for the operation. The controller is further configured to generate the status indicator, indicative of the score of the operation, based at least in part on the comparison of the provisional value and the one or more thresholds.

In yet another embodiment of the present disclosure, a machine is provided. The machine includes an implement configured to perform an automated earth-moving operation. The machine also includes a metering sensor configured to determine the fuel consumption rate value of the machine for the automated earth-moving operation. The machine further includes a control system configured to monitor the automated earth-moving operation. The control system includes a communication device configured to receive the fuel consumption rate value of the machine. The control system also includes a memory configured to store the fuel consumption rate value. The control system further includes a controller in communication with the memory. The controller is configured to generate the provisional value based at least in part on the fuel consumption rate value for the operation. The controller is further configured to determine one or more thresholds for the operation. The one or more thresholds correspond to the normal fuel consumption rate value of the machine for the operation. The controller is further configured to generate the status indicator, indicative of the score of the operation, based at least in part on the comparison of the provisional value and the one or more thresholds.

Other features and aspects of this disclosure will be apparent from the following description and the accompanying drawings.

DETAILED DESCRIPTION

Reference will now be made in detail to specific aspects or features, examples of which are illustrated in the accompanying drawings. Wherever possible, corresponding or similar reference numbers will be used throughout the drawings to refer to the same or corresponding parts.

Figure 1:
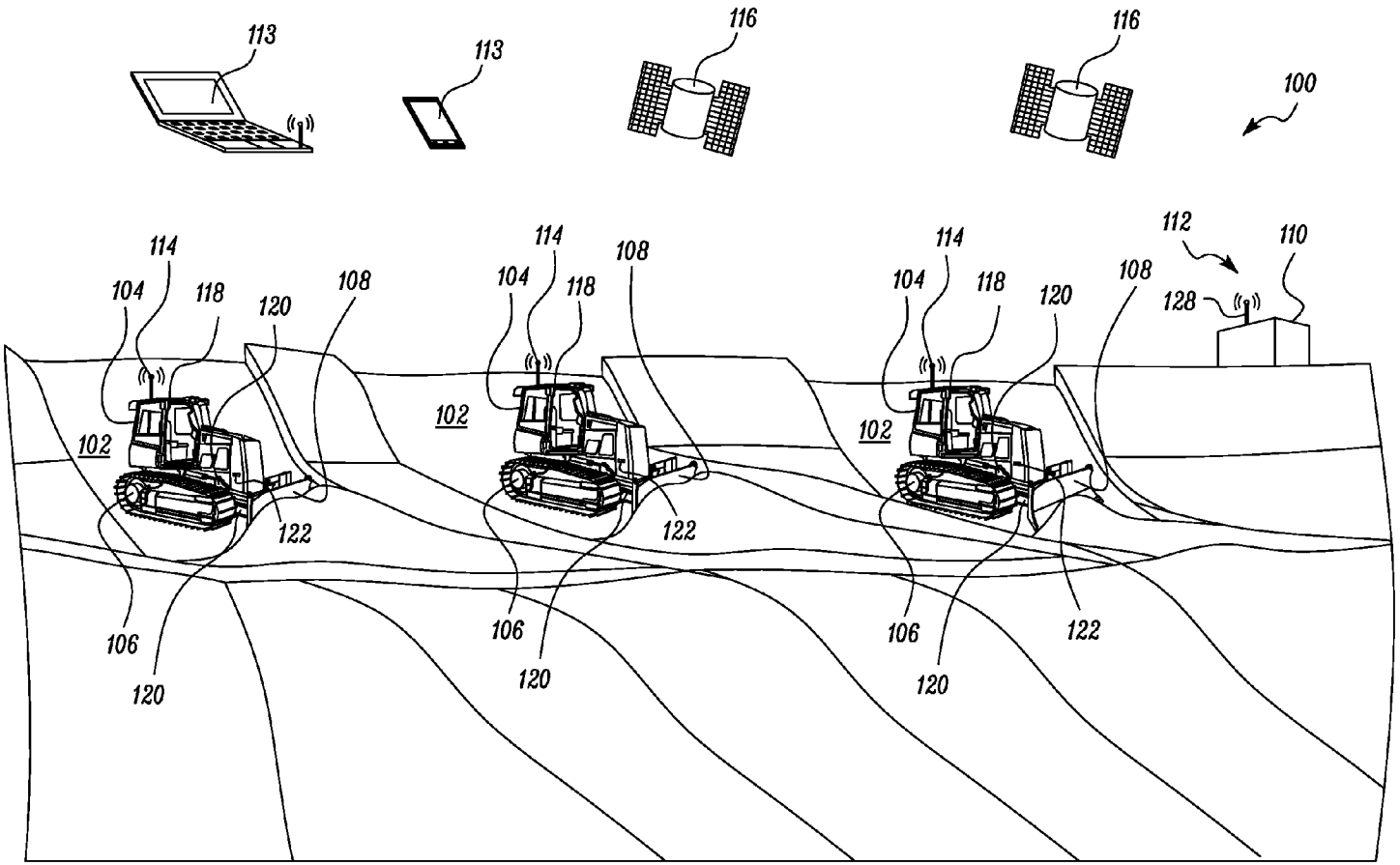
FIG. 1 is a pictorial perspective view of an exemplary worksite and machines operating in the worksite, according to an embodiment of the present disclosure.

FIG. 1 illustrates a perspective view of a worksite 100 having a work surface 102. The worksite 100 may be, for example, a mine site, a landfill, a quarry, a road site, a farm, a construction site, or any other similar type of worksite. Further one or more machines 104, as depicted in FIG. 1, are provided to perform predetermined operations in the worksite 100. The predetermined operations may be associated with altering the work surface 102, such as a dozing operation, a grading operation, a leveling operation, a bulk material removal operation, or any other type of operation that results in geographical modifications within the worksite 100. For example, the machines 104 may be configured to excavate areas of the worksite 100 according to one or more predefined excavation plans. The excavation plans may include, among other things, defining the location, size, and shape of a plurality of cuts intended in the work surface 102 at the worksite 100.

In the illustrated embodiment of the present disclosure, the machines 104 may be automated or semi-automated machines, or any type of manually operated machines configured to perform operations associated with industries related to mining, construction, farming, or any other industry known in the art. The machines 104, for example, may embody earth moving machines, such as dozers having traction devices 106, such as tracks, wheels, or the like. Alternatively, the machine 104 may be an off-highway vehicle, such as an excavator, a backhoe, a loader, a motor grader, or any other vehicle for performing various earth moving operations. As illustrated, the machines 104 may include implements 108, such as, movable blades or any other machine implements, configured to perform the requisite earth-moving operations at the worksite 100.

The present disclosure provides a control system 110 configured to at least partially manage operations of the machines 104 and the implements 108 within the worksite 100. The control system 110 may be embodied in any number of different configurations. In an embodiment, as illustrated in FIG. 1, the control system 110 may be implemented in a computing device (not shown) disposed in a command center 112. The command center 112 may be located remotely and/or locally relative to the worksite 100. In other embodiments, the control system 110 may be implemented in a computing device (not shown) disposed on-board in any one or more of the machines 104, such as, manually operated machines. In some other embodiments, the control system 110 may be partially implemented in the computing device disposed on-board the machines 104, and partially in the computing device disposed in the command center 112. In still other embodiments, the control system 110 may be implemented in a mobile device 113 with the operator, where the operator may be monitoring the machines 104 locally and/or remotely relative to the worksite 100 and/or the machines 104. In yet other embodiments, the control system 110 may partially be implemented in a cloud based server (not shown) and partially in the computing device disposed in the command center 112 or on-board the machine 104 or the mobile device 113.

Each of the machines 104 may include one or more feedback devices 114 capable of signaling, tracking, monitoring, or otherwise transmitting machine parameters or other related information to the control system 110. The machine parameters may include information, such as, but not limited to, machine slope, machine slip, fuel consumption rates, implement power, pass duration, pass distance, engine speed, engine load, and the like. The feedback devices 114 may communicate with one or more satellites 116, which in turn, may communicate the information to the control system 110. Each of the machines 104 may also include a location sensor 118 configured to communicate various information pertaining to the position and/or orientation information of the machines 104 relative to the worksite 100 to the control system 110, via the feedback devices 114. The machines 104 may additionally include one or more implement sensors 120 configured to track and communicate position and/or orientation information of the implements 108 to the control system 110.

The machines 104 may also include metering sensors 122 configured to determine a fuel consumption rate value 'F' in the machines 104. The metering sensor 122 may determine the fuel consumption rate value 'F' based on measuring a flow rate of fuel in the machine 104 or by any other known technique in the art. The metering sensors 122, in various machines 104, may be one of an optical flow meter, a magnetic flow meter, an ultrasonic flow meter or any other flow meters capable of being implemented in the machine 104 to provide a reading of the fuel consumption rate value 'F'. The fuel consumption rate value 'F' may be an instantaneous flow rate of the fuel in the machine 104. Alternatively, the fuel consumption rate value 'F' may be the flow rate of the fuel over predefined intervals. The metering sensor 122 may further be configured to communicate the fuel consumption rate value 'F' to the control system 110 via the feedback devices 114.

Figure 2:
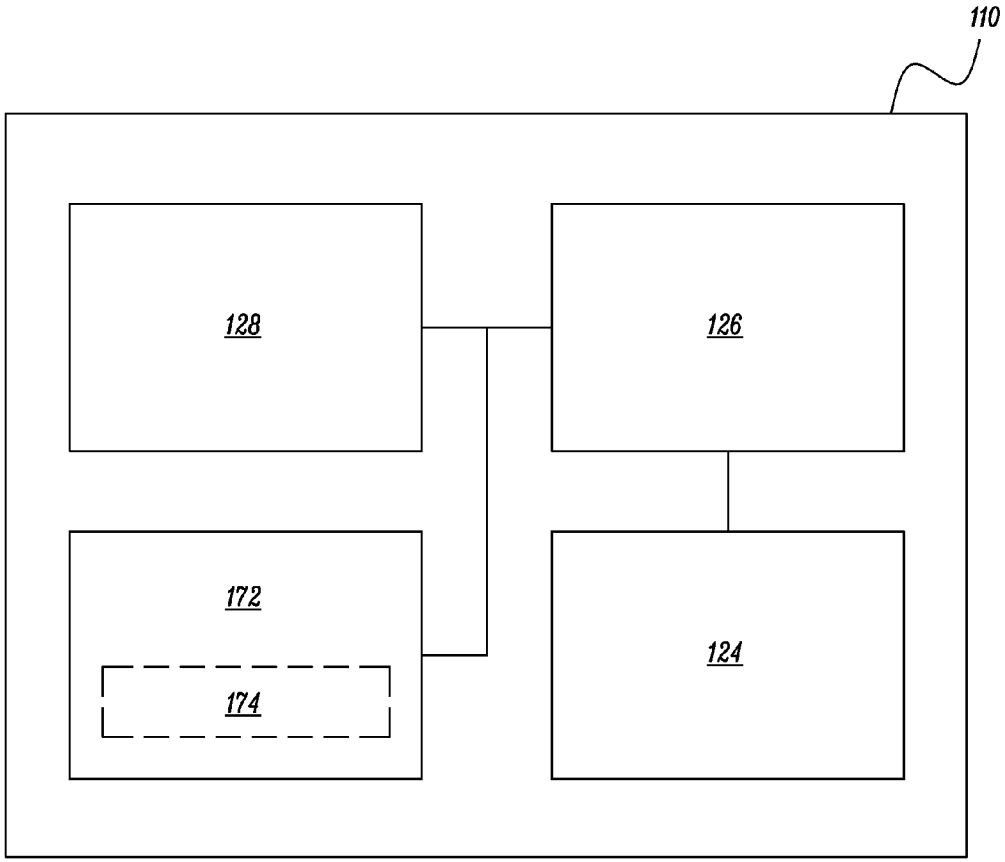
FIG. 2 is a block diagram of a control system, according to an embodiment of the present disclosure.

FIG. 2 illustrates an embodiment of the control system 110 that may be used in conjunction with the machines 104. The control system 110 may include a memory 124 and a controller 126 in communication with each other. The memory 124 may be provided either on-board relative to the controller 126 or external to the controller 126 in communication therewith over a data bus or the like. The memory 124 may include non-transitory computer-readable medium or memory, such as a disc drive, flash drive, optical memory, magnetic drive, or the like. The memory 124 may retrievably store one or more algorithms having a set of instructions to manage the machines 104 and the implements 108 in the worksite 100. The controller 126, on the other hand, may be a logic unit using any one or more of a processor, a microprocessor, a microcontroller, or any other suitable means. The controller 126 may be configured to execute the one or more algorithms stored in the memory 124.

The control system 110 may also include one or more communication devices 128. The communication device 128, also illustrated in FIG. 1, may be configured to communicate with the feedback devices 114 disposed in the machines 104, for example, via the satellites 116, or any other suitable means of communication. The communication device 128 may be configured to receive data from the location sensors 118, the implement sensors 120, the metering sensors 122, among other sensors in the machines 104 via the feedback devices 114. For instance, the communication devices 128 may enable the controller 126 to receive data pertaining to the position and/or orientation of the machines 104 and the implements 108.

Figure 3:
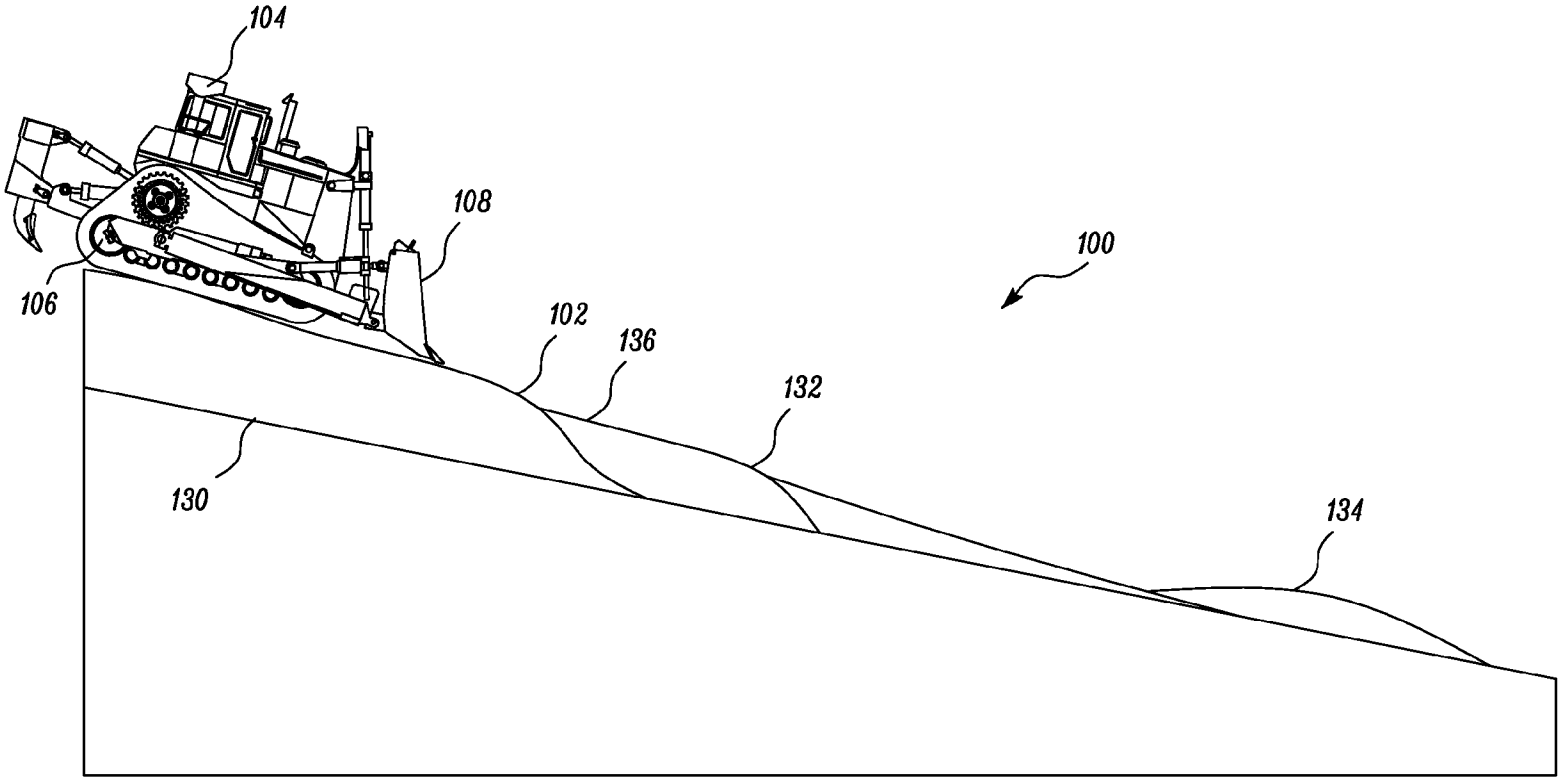
FIG. 3 is a schematic planar view of the machine performing an operation within the worksite, according to an embodiment of the present disclosure.

Referring to FIG. 3, the machine 104 is shown performing an operation 'O' in the worksite 100. The operation 'O' may be a manual operation, a semi-automated operation or an automated operation based on the requirements of the operation. The operation 'O' may be an automated earth-moving operation. The operation 'O' may be planned along a cut profile 130 and, for instance, be defined as a repeatable cycle including the operations of engaging a cut at a first cut location 132, loading material into the implement 108 of the machine 104, carrying or dumping the loaded material over a crest 134 of the worksite 100, and returning the machine 104 to a subsequent or a second cut location 136. The control system 110 may further be able to define specific operations planned for certain areas in the worksite 100, such as a pass, a cut, an implement path and a loading profile within the operation 'O'. Hereinafter, the terms "operation", "automated operation", "earth-moving operation" and "automated earth-moving operation" have been interchangeably used.

In an embodiment, the control system 110 may be configured for monitoring the operation 'O' performed by the machine 104. The control system 110 may be configured to generate a score 'S' of the operation 'O' performed by the machine 104. The score 'S' may be indicative of one or more of the productivity, profitability and efficiency of the operation 'O'. For the purpose of the present disclosure, the terms productivity, profitability and efficiency are interchangeably used hereinafter. The score 'S' may be defined in the form of percentage of current productivity of the operation 'O', measured based on some parameters, to peak productivity possible for the operation 'O' measured based on same parameters. In such case, the score 'S' with value equivalent to 90% may therefore be indicative that the operation 'O' is being performed with 90% productivity. A peak score of the operation may be indicative that the operation 'O' is being performed with peak productivity.

In an embodiment, the control system 110 may further be configured to generate a status indicator indicative of the score 'S' of the operation 'O'. The status indicators may assist the operator to monitor and assess the productivity of the operation 'O', and identify any suboptimal conditions of the machine 104 during the operation 'O'. The status indicator may be generated as different types of status indicator that provide different indications for different ranges of the score 'S'. The different types of status indicator may be represented using different color-coded schemes. Alternatively, the status indicators may be provided using other visual cues, audible and/or haptic schemes that are easily noticeable and suited to promptly indicate suboptimal conditions to the operator.

In the control system 110, the controller 126 may be configured to sequentially perform calculations according to the one or more algorithms in order to generate the status indicator. The communication device 128 may be configured to receive the fuel consumption rate value 'F' of the machine 104. The fuel consumption rate value 'F' may be stored in the memory 124 of the control system 110. The fuel consumption rate value 'F' may be temporarily stored in the memory 124 to be retrieved by the controller 126.

The fuel consumption rate value 'F' may peak when the peak productivity of the operation O' is reached. When the machine 104 is underpowered and not performing the operation 'O' at peak productivity, for example in a loading operation where the load carried by the machine 104 is lower than the load capacity of the machine 104, or in a cutting operation when a depth of cut is lower than desired, the fuel consumption rate value 'F' may eventually drop. In other condition, where the machine is overpowered due to slippage of the traction devices 106, the fuel consumption rate value 'F' may eventually drop again as the machine 104 now requires lesser amount of fuel to spin the traction devices 106.

The controller 126 may be configured to generate a provisional value 'P' based at least in part on the fuel consumption rate value 'F' for the operation 'O'. The provisional value 'P' may take many forms as per the requirement of monitoring the operation 'O'. For example, the provisional value 'P' may be equivalent to the fuel consumption rate value 'F', and is generated directly as the fuel consumption rate value 'F' of the machine 104. In an embodiment, the provisional value 'P' may be equivalent to an average fuel consumption rate value 'A', and is generated by averaging the instances of the fuel consumption rate values 'F' of the machine 104 during the course of the operation 'O'. In other embodiments, the provisional value 'P' may use some other variations of the fuel consumption rate value 'F', such as, but not limited to, normalized fuel consumption rate value, average normalized fuel consumption rate value, or any other possible variation for the purpose.

The controller 126 may further be configured to determine a normal fuel consumption rate value 'N' for the operation 'O'. The normal fuel consumption rate value 'N' may be indicative of the peak score of the operation 'O'. In one example, the normal fuel consumption rate value 'N' may be equivalent to the fuel consumption rate value 'F' of the machine 104, when the machine 104 is performing the operation 'O' with the peak score. In other example, the normal fuel consumption rate value 'N' may be equivalent to the average fuel consumption rate value 'A' of the machine 104, when the machine 104 is performing the operation 'O' with the peak score. The normal fuel consumption rate value 'N' may be predefined or dynamically generated based on the machine parameters during the operation 'O'.

The controller 126 may further be configured to determine one or more thresholds for the operation 'O'. The one or more thresholds may be determined based on the normal fuel consumption rate value 'N' for the operation 'O'. The one or more thresholds may correspond to the normal fuel consumption rate value 'N'. In an embodiment, the controller 126 may be configured to determine two thresholds, a first threshold and a second threshold. It may be understood that the controller 126 may be configured to determine fewer or more thresholds. In an example, the first threshold may be equivalent to 60% of the normal fuel consumption rate value 'N', and the second threshold may be equivalent to 80% of the normal fuel consumption rate value 'N'. It may be understood that the aforementioned percentages are exemplary only, and may vary as per the requirements of monitoring the operation 'O'.

The controller 126 may further be configured to generate the status indicator. The status indicator is generated based on a comparison of the provisional value 'P' and the one or more thresholds. In an embodiment, the controller 126 may be configured to generate three types of status indicators based on the comparison of the provisional value 'P' and the one or more thresholds. The status indicator is generated as one of a critical status indicator 'S1', a cautionary status indicator 'S2', and a normal status indicator 'S3'. The critical status indicator S1 may be generated when the provisional value 'P' is less than or equal to the first threshold. The cautionary status indicator S2 is generated when the provisional value 'P' may be greater than the first threshold but less than or equal to the second threshold. The normal status indicator 'S3' is generated when the provisional value 'P' may be greater than both of the first threshold and the second threshold.

The controller 126 may also be configured to generate the score 'S' of the operation 'O'. The score 'S' may be generated based on a comparison of the provisional value 'P' and the normal fuel consumption rate value 'N'. For example, the score 'S' may be generated as a ratio or a percentage of the provisional value 'P' to the normal fuel consumption rate value 'N'. The score 'S' may be a numerical value indicative of the productivity of the operation 'O' performed by the machine 104. The score 'S' having a percentage of 100% or a ratio of 1 corresponds to the peak score and indicates that the machine 104 may be operating at peak productivity for at least the operation 'O' or particular stages of the operation 'O'. The score 'S' substantially lower than 100% or 1 may indicate suboptimal productivity of the operation 'O'. Therefore higher the score 'S', the higher the productivity of the operation 'O' and vice-versa. In some embodiments, the score 'S' may be used for generating the status indicator.

The controller 126 may be configured to generate the provisional value 'P' at predefined intervals during the operation 'O'. Accordingly, the controller 126 may be configured to update the status indicator after each predefined interval based on the provisional value 'P'. Further as discussed above, the operation 'O' may include multiple repeatable cycles of the operation 'O'. In such cases, the controller 126 may be configured to apply the provisional value 'P' generated for a prior cycle as the provisional value 'P' for a subsequent cycle. The controller 126 may additionally be configured to reset the provisional value 'P' based on a change in the machine parameters in the subsequent cycle.

Figure 6:
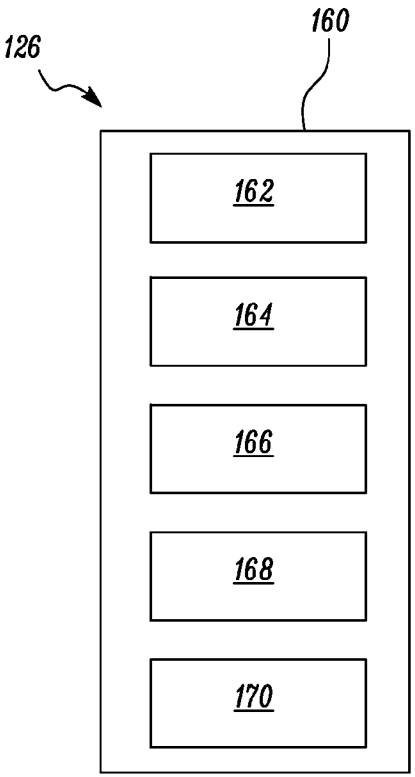
FIG. 6 is a block diagram of a third controller, according to an embodiment of the present disclosure.
Figure 5:
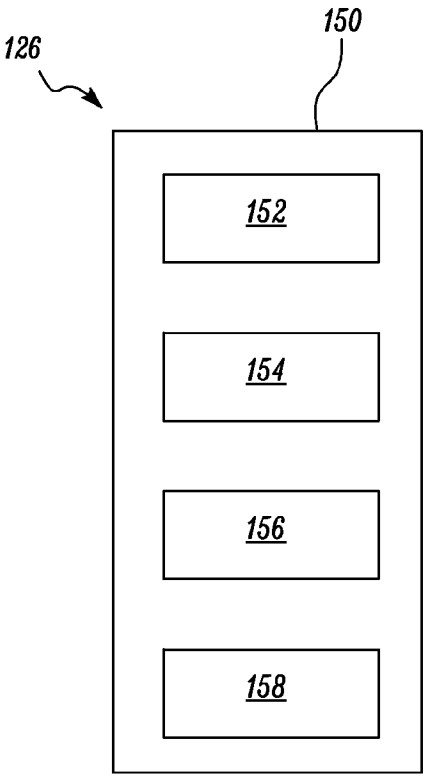
FIG. 5 is a block diagram of a second controller, according to an embodiment of the present disclosure.
Figure 4:
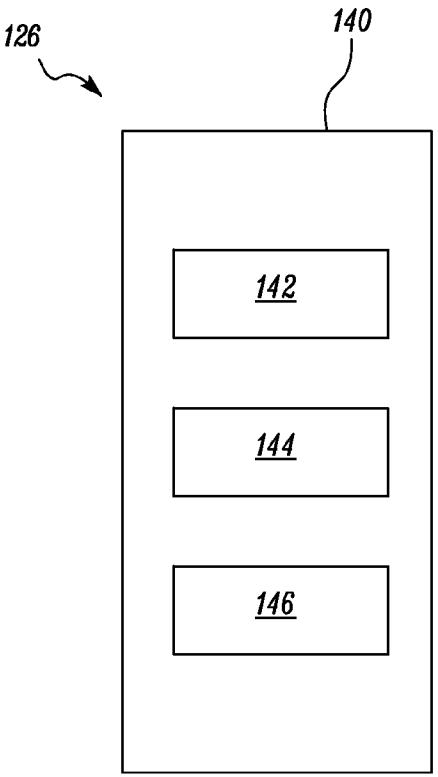
FIG. 4 is a block diagram of a first controller, according to an embodiment of the present disclosure.

FIGS. 4-6 illustrate three different embodiments of the controller 126 showing some of the possible configurations of the controller 126 to implement the algorithms for generating the status indicator. In particular, the embodiments of FIGS. 4-6 show the controller 126 being implemented in three different configurations. In FIG. 4, the controller 126 is shown as a first controller 140. In FIG. 5, the controller 126 is shown as a second controller 150. In FIG. 6, the controller 126 is shown as a third controller 160. It may be understood that any one of the first controller 140, the second controller 150 or the third controller 160 may be employed as the controller 126 in the control system 110 based on the consideration of the parameters for generating the status indicator, as discussed in detail hereinafter.

In FIG. 4, a first controller 140 is illustrated in which the one or more algorithms may be generally categorized to include a first pass identification module 142, a first determination module 144 and a first status indicator module 146. In FIG. 5, a second controller 150 is illustrated in which the one or more algorithms may be generally categorized to include a second pass identification module 152, a second averaging module 154, a second determination module 156 and a second status indicator module 158. In FIG. 6, a third controller 160 is illustrated in which the one or more algorithms may be generally categorized to include a third pass identification module 162, a third normalization module 164, a third averaging module 166, a third determination module 168 and a third status indicator module 170. It may be noticed that a first averaging module, and a first normalization module and a second normalization module have not been defined. These have been deliberately omitted for clear understanding of the present disclosure.

The pass identification modules 142, 152, 162 may configure the respective controllers 140, 150, 160 to determine if the machine 104 is currently operational and whether the machine 104 is currently performing the operation 'O'. The pass identification modules 142, 152, 162 may also configure the controllers 140, 150, 160 to determine the current stage of the operation 'O', that is, a cut operation, a pass operation, an idle operation, or any other stage of the operation 'O' by processing the machine parameters. The pass identification modules 142, 152, 162 may also configure the controllers 140, 150, 160 to spatially identify and define the operation 'O' to be performed relative to the worksite 100. Based on the desired application, the pass identification modules 142, 152, 162 may further configure the controllers 140, 150, 160 to define each operation 'O' or cycle to include other combinations of operations.

In the second controller 150, when the machine 104 starts performing the operation 'O', as determined by the second pass identification module 152, the second averaging module 154 may configure the second controller 150 to begin generating or otherwise calculating the average fuel consumption rate value 'A', as the provisional value 'P', associated with the operation 'O'. The average fuel consumption rate value 'A' may be generated based on the fuel consumption rate value 'F' stored in the memory 124, as received by the communication devices 128. In this manner, the second averaging module 154 may configure the second controller 150 to continue generating the average fuel consumption rate value 'A' for the duration of the given operation 'O', such as at predefined intervals of time, distance, or any other designations. Alternatively, the second averaging module 154 may generate the average fuel consumption rate value 'A' once per operation 'O' or cycle. Still alternatively, the second averaging module 154 may update the average fuel consumption rate value 'A' for every fuel consumption rate value 'F' that is received during the operation 'O'.

In the third controller 160, when the machine 104 starts performing the operation 'O', as determined by the third pass identification module 162, the third normalization module 164 may configure the third controller 160 to begin generating or otherwise calculating a normalized fuel consumption rate value 'NF' associated with the machine 104. The normalized fuel consumption rate value 'NF' may be generated as a percentage or ratio of the fuel consumption rate value 'F' to the normal fuel consumption rate value 'N'. Correspondingly, a normalized fuel consumption rate value 'NF' having a percentage of 100% or a ratio of 1 indicates that the machine 104 may be operating at peak productivity for at least the operation 'O' or particular stages of the operation 'O'. The normalized fuel consumption rate value 'NF' substantially lower than 100% or 1 may indicate suboptimal productivity of the operation 'O' due to the machine 104 being underpowered and carrying lower volume of loads, or the like, or the machine 104 being overpowered and exhibiting higher rates of slip of the traction devices 106, or the like.

Moreover in the third controller 160, while the third normalization module 164 generates the normalized fuel consumption rate value 'NF', the third averaging module 166 may configure the third controller 160 to generate an average normalized fuel consumption rate value 'AN', as the provisional value 'P', for the operation 'O'. For example, the third averaging module 166 may generate the average normalized fuel consumption rate value 'AN', as the average of the normalized fuel consumption rate values generated during the course of the operation 'O'. Alternatively, the third averaging module 166 may generate the average normalized fuel consumption rate value 'AN' once per operation 'O' or cycle. Still alternatively, the third averaging module 166 may update the average normalized fuel consumption rate value 'AN' for every normalized fuel consumption rate value 'NF' that is calculated by the third normalization module 164 for duration of the operation 'O'.

Referring back to FIGS. 4-6, the determination modules 144, 156, 168 may configure the respective controllers 140, 150, 160 to determine one or more thresholds. The thresholds may be determined based on the operation 'O' being carried out by the machines 104. The determination modules 144, 156, 168 may configure the controllers 140, 150, 160 to automatically and/or dynamically adjust the thresholds based on detected changes in the machine 104, worksite 100, or other factors. Then again, the determination modules 144, 156, 168 may configure the controllers 140, 150, 160 to allow the operator to manually modify including predefine or change the one or more thresholds.

The determination modules 144, 156, 168 may configure the respective controllers 140, 150, 160 to determine two thresholds in each case. For instance, the first determination module 144 may configure the first controller 140 to determine a first threshold 'TF1' and a second threshold 'TF2' for the fuel consumption rate value 'F'. The second determination module 156 may configure the second controller 150 to determine a first threshold 'TA1' and a second threshold 'TA2' for the average fuel consumption rate value 'A'. The third determination module 168 may configure the third controller 160 to determine a first threshold 'TN1' and a second threshold 'TN2' for the average normalized fuel consumption rate value 'AN'. The determination modules 144, 156, 168 may configure the controllers 140, 150, 160 with fewer or more thresholds as per the requirements for lesser or more status indicators for the operation 'O'.

Using one or more thresholds, the status indicator modules 146, 158, 170 may configure the respective controllers 140, 150, 160 to generate the status indicator. Specifically, the first status indicator module 146 may configure the first controller 140 to qualify the fuel consumption rate value 'F' based on a comparison with the thresholds TF1, TF2. The second status indicator module 158 may configure the second controller 150 to qualify the average fuel consumption rate value 'A' based on a comparison with the thresholds TA1, TA2. The third status indicator module 170 may configure the third controller 160 to qualify the average normalized fuel consumption rate value 'AN' based on a comparison with the thresholds TN1, TN2.

In an embodiment, the status indicator modules 146, 158, 170 may configure the respective controllers 140, 150, 160 to selectively generate one of the critical status indicator 'S1', the cautionary status indicator 'S2', and the normal status indicator 'S3'. In the first controller 140, the first status indicator module 146 may configure the first controller 140 to generate the critical status indicator 'S1' when the fuel consumption rate value 'F' is less than or equal to the first threshold 'TF1'. The cautionary status indicator 'S2' may be generated when the fuel consumption rate value 'F' is greater than the first threshold 'TF1' but less than or equal to the second threshold 'TF2'. The normal status indicator 'S3' may be generated when the fuel consumption rate value 'F' is greater than both of the first threshold 'TF1' and the second threshold 'TF2'. Moreover, the first status indicator module 146 may configure the first controller 140 to update the status indicator for each consecutive fuel consumption rate value 'F' that is determined.

Similarly in the second controller 150, the second status indicator module 158 may configure the second controller 150 to generate the critical status indicator 'S1' when the average fuel consumption rate value 'A' is less than or equal to the first threshold 'TA1'. The cautionary status indicator 'S2' may be generated when the average fuel consumption rate value 'A' is greater than the first threshold 'TA1' but less than or equal to the second threshold 'TA2'. The normal status indicator 'S3' may be generated when the average fuel consumption rate value 'A' is greater than both of the first threshold 'TA1' and the second threshold 'TA2'. Moreover, the second status indicator module 158 may configure the second controller 150 to update the status indicator for each consecutive average fuel consumption rate value 'A' that is generated by the second averaging module 154.

And similarly in the third controller 160, the third status indicator module 170 may configure the third controller 160 to generate the critical status indicator 'S1' when the average normalized fuel consumption rate value 'AN' is less than or equal to the first threshold 'TN1'. The cautionary status indicator 'S2' may be generated when the average normalized fuel consumption rate value 'AN' is greater than the first threshold 'TN1' but less than or equal to the second threshold 'TN2'. The normal status indicator 'S3' may be generated when the average normalized fuel consumption rate value 'AN' is greater than both of the first threshold 'TN1' and the second threshold 'TN2'. Moreover, the third status indicator module 170 may configure the third controller 160 to update the status indicator for each consecutive average normalized fuel consumption rate value 'AN' that is generated by the third averaging module 166.

In the illustrated embodiment of FIG. 2, the control system 110 is further shown to include one or more output devices 172. The output devices 172 may be configured to receive the status indicator directly from the controller 126. Otherwise, the communication devices 128 may be configured to receive the status indicator from the controller 126 and transmit the status indicator to the output devices 172. The output devices 172 may employ any combination of display screens, touchscreens, light-emitting diodes (LEDs), speakers, haptic devices, and the like, to provide one or more of visual, audible and/or haptic indications to the operator of the machines 104.

In an embodiment, the output devices 172 may be disposed in the command center 112 from where the operator may be monitoring and/or controlling the operations of the machine 104, such as for the machines 104 to be operated autonomously. In other embodiments, the output devices 172 may be disposed on-board within the machines 104, such as for the machines 104 to be operated manually. In still other embodiments, the output devices 172 may be disposed in the command center 112 or the machines 104, or partially in the command center 112 and partially in the machines 104, such as for semi-autonomous machines. Alternatively, the output device 172 may be in the form of a mobile device, such as a smartphone, a tablet, a PDA, or the like which enables the operator to remotely monitor the status of the work being performed.

Figure 7:
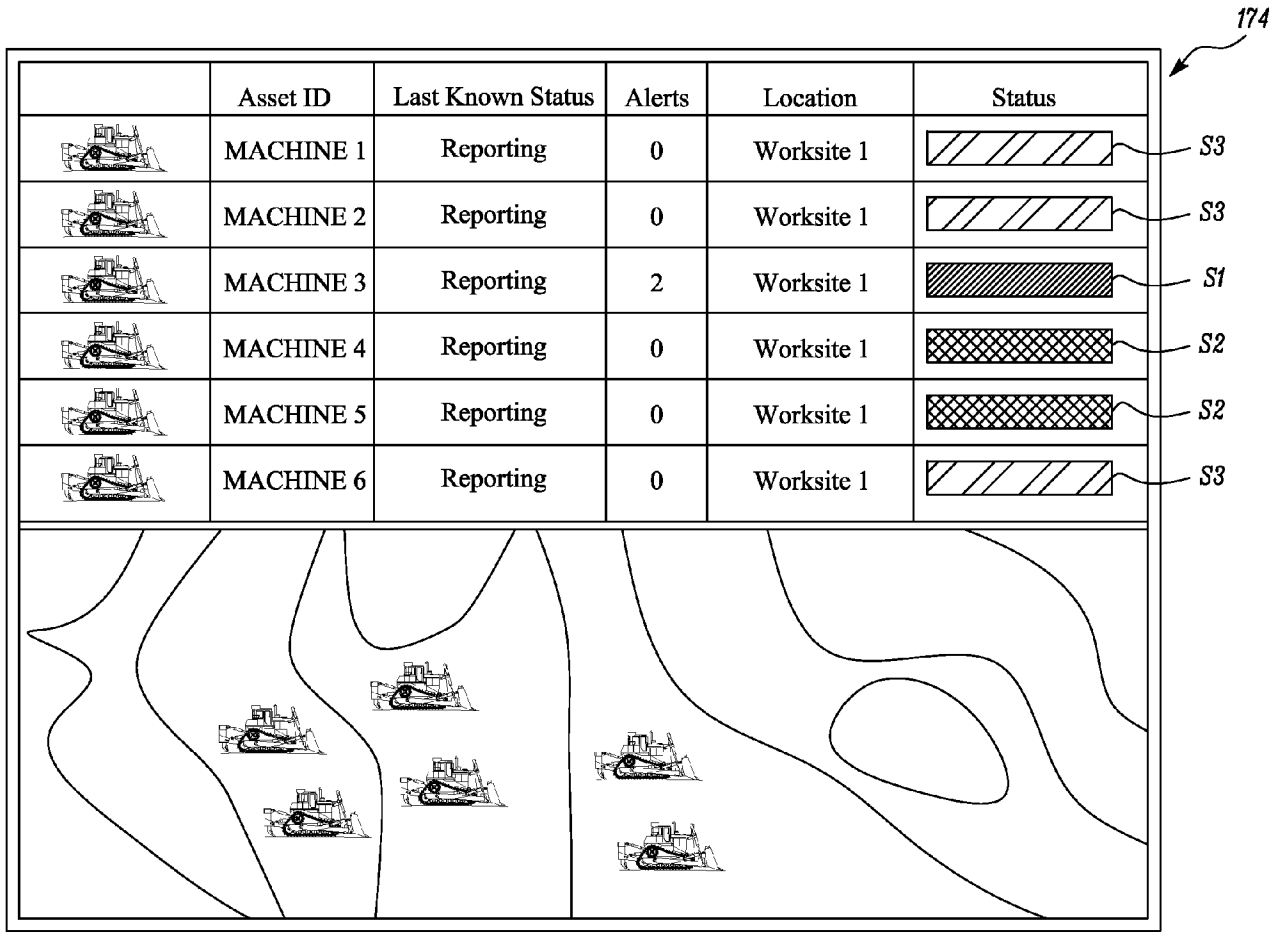
FIG. 7 is a graphical representation of an exemplary operator interface, according to an embodiment of the present disclosure.

FIG. 7 illustrates an exemplary embodiment of an operator interface 174 for the one or more output devices 172. The output devices 172 may be configured to communicate the status indicator to the operator via the operator interface 174. The output devices 172 may also be configured to communicate information to the operator corresponding to the operating conditions of the machine 104, the progress of the work or operation being performed, and any other indications of efficiency, productivity, errors, deviations, suboptimal operating conditions, and the like via the operator interface 174. The operator interface 174 may be able to communicate such information based at least in part on the status indicator generated by the controller 126. The operator interface 174 of FIG. 7 is exemplary only and may be modified to include or exclude some parameters as per the requirement of monitoring, assessing and/or controlling the operation 'O' performed by the machine 104.

In an embodiment, the different types of the status indicator may be communicated using a color-coded scheme. For example, as representatively illustrated in FIG. 7, a critical status indicator 'S1' may be presented in 'RED' in the operator interface 174 to indicate that the machine 104 is carrying out the operation 'O' with a poor score 'S' and that operator intervention may be required. A cautionary status indicator 'S2' may be presented in 'YELLOW' to indicate that the machine 104 is carrying out the operation 'O' at a suboptimal but acceptable score 'S', and to serve as a warning that operator intervention may be required. Correspondingly, a normal status indicator 'S3' may be presented in 'GREEN' in the operator interface 174 to indicate that the operation 'O' is being carried out at or near a peak score and that no intervention may be required at the moment.

In some modifications, the status indicator may be communicated using different color-coded schemes or any other visual cues that are easily noticeable and suited to promptly indicate suboptimal conditions to the operator. In other modifications, the different types of status indicator may be communicated using audible and/or haptic schemes. In further modifications, the operator interface 174 may also communicate the score 'S' of the operation 'O' directly to the operator. In still further modifications, the operator interface 174 may also communicate some additional information, instructions and/or suggestions relating to the different types of status indicator which may guide the operator in correcting any issues or deficiencies detected during the operation 'O'.

INDUSTRIAL APPLICABILITY

The present disclosure provides system and method for monitoring an operation performed by a machine. The present disclosure provides system and method to guide the machines in an efficient, productive and predictable manner in the worksite. In particular, the present disclosure provides system and method that enable earlier detection and flagging of suboptimal operating conditions or deviations from the work plan which may potentially impact overall productivity. Although applicable to any type of machine, the present disclosure may be particularly applicable to autonomously or semi-autonomously controlled dozing machines where the dozing machines are controlled to perform automated earth-operations in a worksite. The present disclosure provides a score of an operation indicative of a productivity rating of the machine for the given operation. Specifically, the present disclosure provides a status indicator, indicative of the score, to simplify the assessment of work productivity for the operator of the machines and helps the operator to promptly respond or intervene as necessary.

Figure 8:
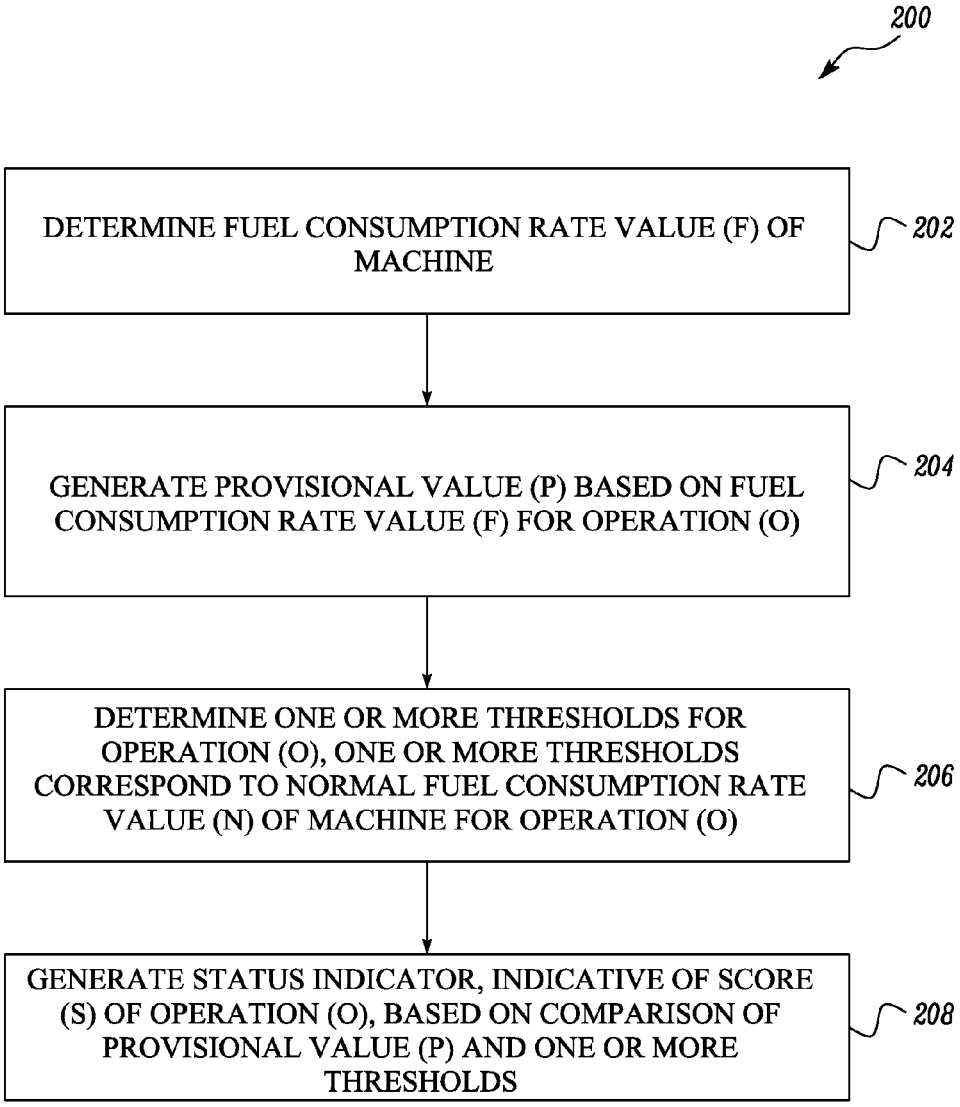
FIG. 8 is a flowchart of a method for monitoring the operation in the machine, according to an embodiment of the present disclosure.

FIG. 8 diagrammatically illustrates a computer implemented method 200 for monitoring the operation 'O' performed by the machine 104, according to which the first controller 140 may be configured to operate. As shown in step 202, the method 200 includes determining the fuel consumption rate value 'F' of the machine 104. The fuel consumption rate value 'F' may be determined by the metering sensor 122 as described above and further stored and retrieved from the memory 124 as necessary. The method 200 may further include determining whether the machine 104 is currently performing the operation 'O'. Further in step 204, the method 200 includes generating the provisional value 'P' based at least in part on the fuel consumption rate value 'F'.

In step 206, the method 200 includes determining one or more thresholds for the operation 'O'. The thresholds may correspond to the normal fuel consumption rate value 'N' of the machine 104 for the operation 'O'. The normal fuel consumption rate value 'N' may be indicative of the fuel consumption rate value 'F' for the peak score of the operation 'O'. The method 200 may include comparing the provisional value 'P' and the thresholds. Further in step 208, the method 200 includes generating the status indicator, indicative of the score 'S' of the operation 'O', based at least in part on the comparison of the provisional value 'P' and the one or more thresholds.

Figure 9:
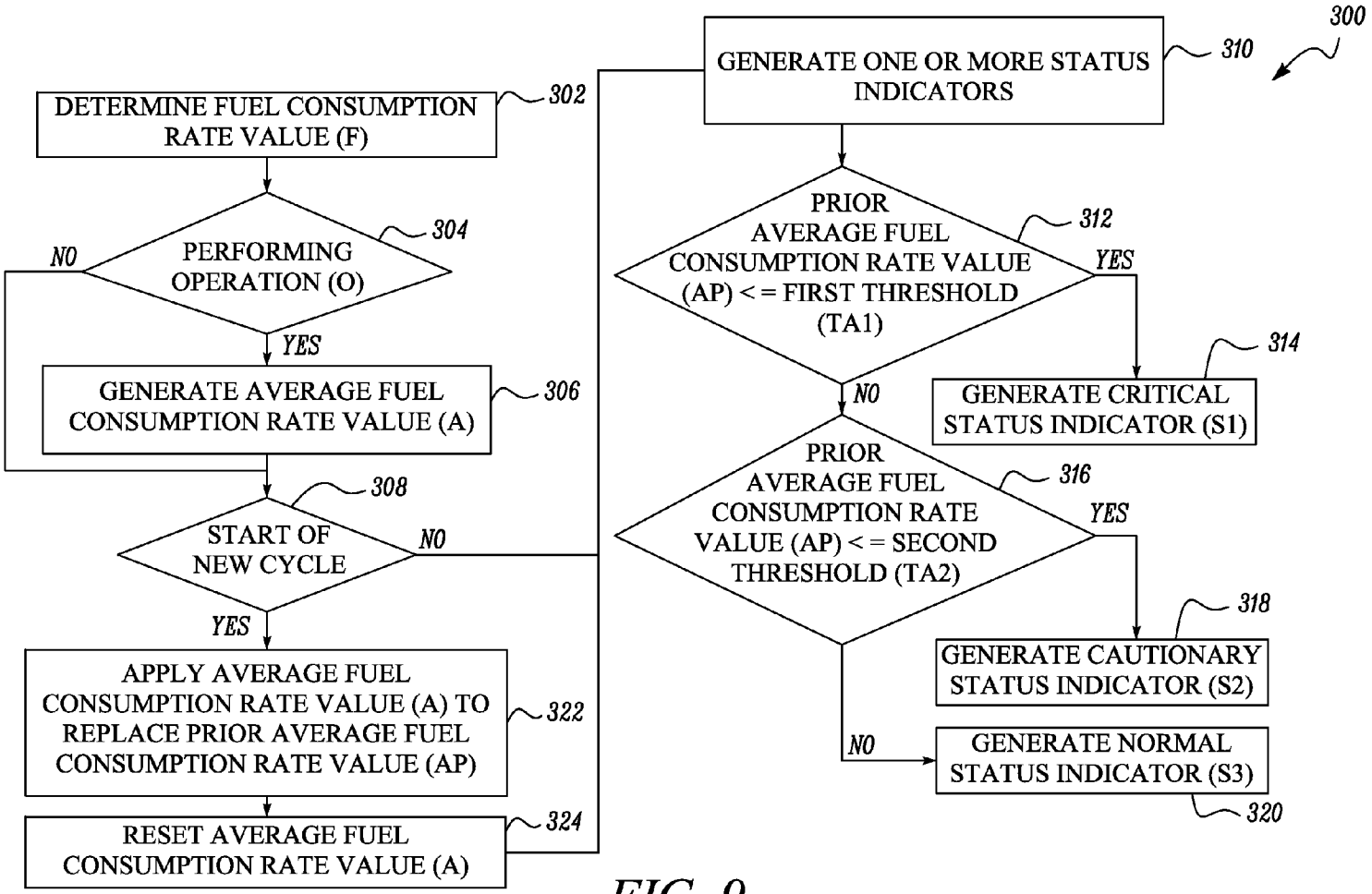
FIG. 9 is a flowchart of a method for monitoring the operation in the machine, according to another embodiment of the present disclosure.

Moving on, FIG. 9 illustrates a detailed embodiment of another exemplary algorithm or a computer implemented method 300 for monitoring the operation 'O', as implemented in the second controller 150. In step 302, the method 300 includes determining the fuel consumption rate value 'F'. In step 304, the method 300 includes determining whether the machine 104 is performing the operation 'O' based on the fuel consumption rate value 'F' or other machine parameters. In step 304, when it is determined that the machine 104 is currently performing the operation 'O', the average fuel consumption rate value 'A' is generated, as shown in step 306. The average fuel consumption rate value 'A' may be generated as the provisional value 'P' for the operation 'O'. The second controller 150 may additionally be configured to determine the thresholds TA1, TA2.

In step 308, the second controller 150 may be configured to check whether a new cycle of the operation 'O' has started. Specifically, the second controller 150 may additionally monitor progress of the machine 104 to determine whether the current cycle of the operation 'O' is still progressing, or whether the machine 104 has completed the initial cycle and is starting a new cycle. If the machine 104 is determined to be continuing along the initial cycle, the second controller 150 may use a prior average fuel consumption rate value 'AP', that is the average fuel consumption rate value 'A' from the prior cycle. The prior average fuel consumption rate value 'AP' may be retrieved from the memory 124. Further the second controller 150, as shown in step 310, may be configured to compare the prior average fuel consumption rate value 'AP' and one or more thresholds TA1, TA2 and generate the status indicator. In step 310, the second controller 150 may additionally be configured to initially switch-off all the status indicators as provided in the operator interface 174 of FIG. 7.

As illustrated, in step 312, if the prior average fuel consumption rate value 'AP' is less than or equal to the first threshold 'TA1', the second controller 150 generates a critical status indicator 'S1', as shown in step 314. The critical status indicator 'S1' may be generated in 'RED' to indicate low productivity and to suggest to an operator that at least some manual intervention or correction of the machine 104 may be needed to restore acceptable productivity levels. Further in step 316, if the prior average fuel consumption rate value 'AP' satisfies the first threshold 'TA1', but is less than or equal to the second threshold 'TA2', the second controller 150 generates the cautionary status indicator 'S2', as illustrated in step 318. The cautionary status indicator 'S2' may be generated in 'YELLOW' to indicate suboptimal but acceptable productivity and to warn the operator of potentially adverse deviations from the planned operation. If the prior average fuel consumption rate value 'AP' satisfies both of the first and second thresholds TA1, TA2, the second controller 150 generates the normal status indicator 'S3', as illustrated in step 318. The normal status indicator 'S3' may be generated in 'GREEN' to indicate desired productivity to the operator.

As shown in step 322, if a new cycle is detected in step 308, the second controller 150 may apply the average fuel consumption rate value 'A', as generated in step 306, to replace the prior average fuel consumption rate value 'AP'. That is, the second controller 150 may apply the average fuel consumption rate value 'A', as generated in step 306, as the average fuel consumption rate value 'A' from which the new cycle may be assessed. In step 324, the second controller 150 may additionally reset the average fuel consumption rate value 'A' to adjust for any detected changes in the machine parameters, work environment, or other factors since the previous cycle. Furthermore, once all updates have been made, the second controller 150 may proceed to generate the status indicator as discussed in the steps above. The second controller 150 may continue updating the average fuel consumption rate value 'A' and the status indicator using the average fuel consumption rate value 'A' for each cycle, or at predefined intervals of time, distance, or other designations within each cycle of the operation 'O'.

Figure 10:
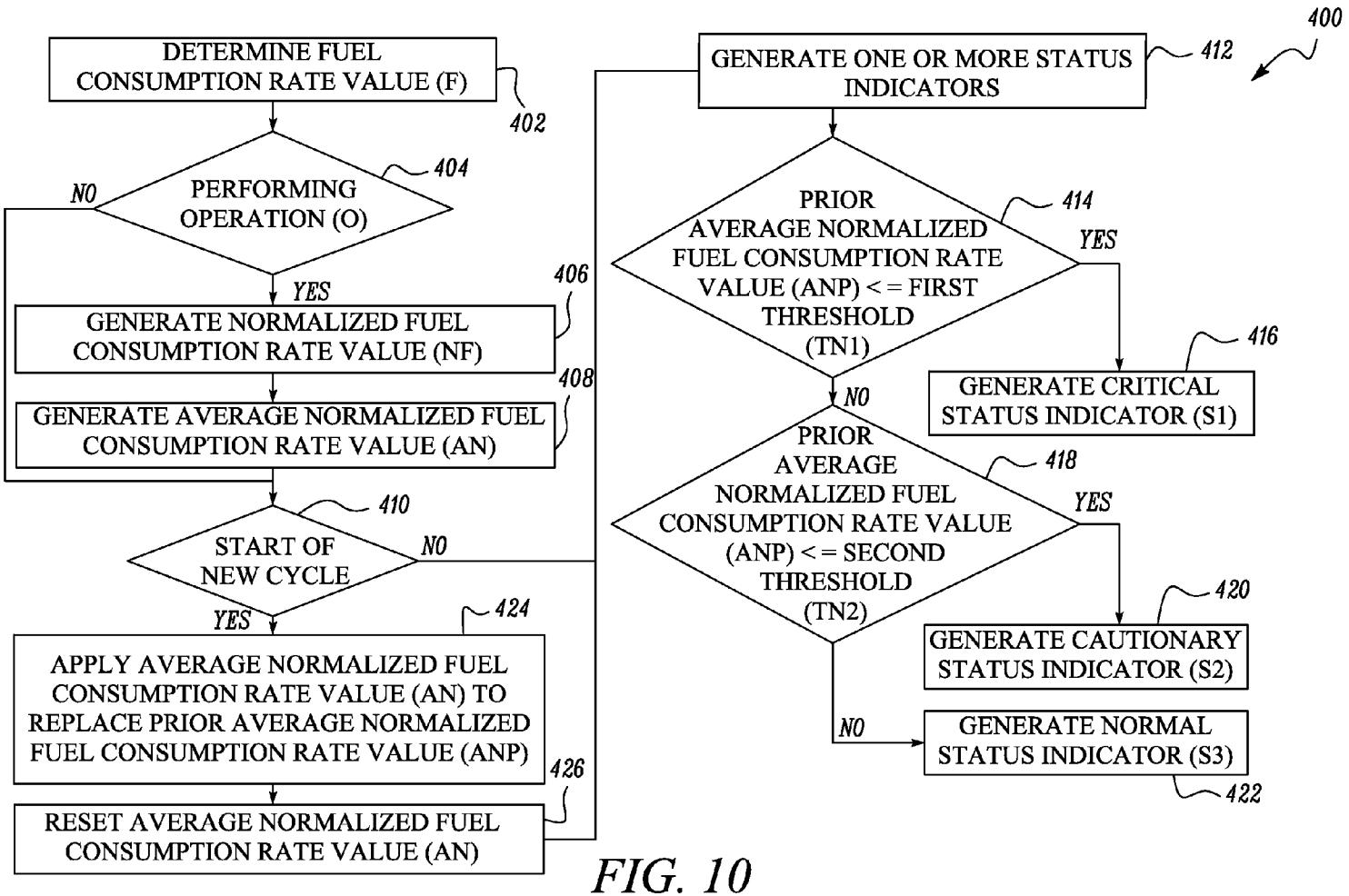
FIG. 10 is a flowchart of a method for monitoring the operation in the machine, according to yet another embodiment of the present disclosure.

FIG. 10 illustrates a method 400 for monitoring the operation 'O', as implemented in the third controller 160. The method 400 may use a different parameter, the average normalized fuel consumption rate value 'AN' instead of the average fuel consumption rate value 'A' as described in the method 300 above. In general, the method 400 includes determining the fuel consumption rate value 'F', as shown in step 402. The method 400 further includes determining whether the machine 104 is currently performing operation 'O', as shown in step 404. Further in step 406 and 408, the method 400 includes generating the normalized fuel consumption rate value 'NF' and the average normalized fuel consumption rate value 'AN' respectively, as described above.

In step 410, the method 400 includes determining whether the current cycle is in progress or a new cycle has started. Specifically, the third controller 150 may additionally monitor progress of the machine 104 to determine whether the current cycle of the operation 'O' is still progressing, or whether the machine 104 has completed the initial cycle and is starting a new cycle. If the machine 104 is determined to be continuing along the initial cycle, the third controller 160 may use a prior average normalized fuel consumption rate value 'ANP', that is the average normalized fuel consumption rate value 'AN' from the prior cycle. The prior average normalized fuel consumption rate value 'ANP' may be retrieved from the memory 124. The method 400 includes comparing the prior average normalized fuel consumption rate value 'ANP' with the thresholds TN1, TN2 to generate the status indicator, as shown in step 412.

In step 414, if the prior average normalized fuel consumption rate value 'ANP' is less than or equal to the first threshold 'TN1', then the critical status indicator 'S1' is generated, as shown in step 416. Further in step 418, if the prior average normalized fuel consumption rate value 'ANP' is greater than the first threshold 'TN1' but less than or equal to the second threshold 'TN2', then the cautionary status indicator 'S2' is generated, as shown in step 420. If the prior average normalized fuel consumption rate value 'ANP' is greater than both the thresholds TN1, TN2, the normal status indicator 'S3' is generated, as shown in step 422.

As shown in step 410, if a new cycle is detected, the third controller 160, as shown in step 424, may apply the average normalized fuel consumption rate value 'AN', as generated in step 408, to replace the prior average normalized fuel consumption rate value 'ANP'. That is, the third controller 160 may apply the average normalized fuel consumption rate value 'AN', as generated in step 408, as the average normalized fuel consumption rate value 'AN' from which the new cycle may be assessed. Further, in step 426, the third controller 160 may additionally reset the average normalized fuel consumption rate value 'AN' to adjust for any detected changes in the machine parameters, work environment, or other factors since the previous cycle and subsequently proceed to generate the status indicator. The third controller 160 may continue updating the average normalized fuel consumption rate value 'AN' and the status indicator using the average normalized fuel consumption rate value 'AN' for each cycle, or at predefined intervals of time, distance, or other designations within each cycle of the operation 'O'.

While aspects of the present disclosure have been particularly shown and described above, it will be understood by those skilled in the art that various additional aspects may be contemplated by the modification of the disclosed machines, systems and methods without departing from the spirit and scope of what is disclosed. Such aspects should be understood to fall within the scope of the present disclosure as determined based upon the claims and any equivalents thereof.

What is claimed is:

1. A computer-implemented method for monitoring an operation of a machine having an implement, the method comprising:

determining a fuel consumption rate value of the machine, the fuel consumption rate value corresponding to a fuel consumption rate by the machine performing the operation;

generating a provisional value based at least in part on the fuel consumption rate value for the operation;

determining one or more thresholds for the operation, the one or more thresholds corresponding to a normal fuel consumption rate value of the machine for performing the operation; and generating a status indicator, indicative of a score of the operation performed by the machine, based at least in part on a comparison of the provisional value and the one or more thresholds, the score of the operation being indicative of productivity and efficiency of the machine performing the operation.

2. The method of claim 1, wherein the provisional value comprises an average fuel consumption rate value, the average fuel consumption rate value being generated based on the fuel consumption rate value for the operation.

3. The method of claim 1 further comprising generating the score of the operation based at least in part on a comparison of the provisional value and the normal fuel consumption rate value, the normal fuel consumption rate value being indicative of a peak score of the operation.

4. The method of claim 1, wherein the status indicator is generated as at least one of a critical status indicator, a cautionary status indicator, or a normal status indicator, the critical status indicator being generated when the fuel consumption rate value is less than or equal to a first threshold, the cautionary status indicator being generated when the fuel consumption rate value is greater than the first threshold but less than or equal to a second threshold, and the normal status indicator being generated when the fuel consumption rate value is greater than both of the first threshold and the second threshold.

5. The method of claim 1, wherein the provisional value is generated at predefined intervals during the operation, and wherein the status indicator is updated after each interval based on the provisional value.

6. The method of claim 1, wherein the operation comprises repeating cycles of the operation, and wherein the provisional value generated for a prior cycle is used as the provisional value for a subsequent cycle.

7. A control system for monitoring an operation of a machine having an implement, the control system comprising:

a communication device configured to receive a fuel consumption rate value of the machine, the fuel consumption rate value corresponding to a fuel consumption rate by the machine performing the operation;

a memory configured to store the fuel consumption rate value; and a controller in communication with the memory, the controller configured to:

generate a provisional value based at least in part on the fuel consumption rate value for the operation;

determine one or more thresholds for the operation, the one or more thresholds corresponding to a normal fuel consumption rate value of the machine for performing the operation; and generate a status indicator, indicative of a score of the operation, based at least in part on a comparison of the provisional value and the one or more thresholds, the score of the operation being indicative of productivity and efficiency of the machine performing the operation.

8. The control system of claim 7, wherein the provisional value comprises an average fuel consumption rate value, the average fuel consumption rate value being generated based on the fuel consumption rate value for the operation.

9. The control system of claim 7, wherein the controller is further configured to generate the score of the operation based at least in part on a comparison of the provisional value and the normal fuel consumption rate value, the normal fuel consumption rate value being indicative of a peak score of the operation.

10. The control system of claim 7, wherein the controller is configured to generate the status indicator as at least one of a critical status indicator, a cautionary status indicator, or a normal status indicator, the critical status indicator being generated when the fuel consumption rate value is less than or equal to a first threshold, the cautionary status indicator being generated when the fuel consumption rate value is greater than the first threshold but less than or equal to a second threshold, and the normal status indicator being generated when the fuel consumption rate value is greater than both of the first threshold and the second threshold.

11. The control system of claim 7, wherein the controller is further configured to generate the provisional value at predefined intervals during the operation, and wherein the status indicator is updated after each interval based on the provisional value.

12. The control system of claim 7, wherein the operation comprises repeating cycles of the operation, the controller being configured to apply the provisional value generated for a prior cycle as the provisional value for a subsequent cycle.

13. The control system of claim 7 further comprising one or more output devices having an operator interface, the one or more output devices configured to receive and communicate the status indicator to an operator of the machine via the operator interface.

14. A machine comprising:

an implement configured to perform an automated earth-moving operation;

a metering sensor configured to determine a fuel consumption rate value of the machine for the automated earth-moving operation, the fuel consumption rate value corresponding to a fuel consumption rate by the machine performing the operation; and a control system configured to monitor the automated earth-moving operation, the control system comprising:

a communication device configured to receive the fuel consumption rate value;

a memory configured to store the fuel consumption rate value; and a controller in communication with the memory, the controller configured to:

generate a provisional value based at least in part on the fuel consumption rate value for the operation;

determine one or more thresholds for the operation, the one or more thresholds corresponding to a normal fuel consumption rate value of the machine for performing the operation; and generate a status indicator, indicative of a score of the operation, based at least in part on a comparison of the provisional value and the one or more thresholds, the score of the operation being indicative of productivity and efficiency of the machine performing the operation.

15. The machine of claim 14, wherein the provisional value comprises an average fuel consumption rate value, the average fuel consumption rate value being generated based on the fuel consumption rate value for the automated earth-moving operation.

16. The machine of claim 14, wherein the controller is further configured to generate the score of the operation based at least in part on a comparison of the provisional value and the normal fuel consumption rate value, the normal fuel consumption rate value being indicative of a peak score of the automated earth-moving operation.

17. The machine of claim 14, wherein the controller is configured to generate the status indicator as at least one of a critical status indicator, a cautionary status indicator, or a normal status indicator, the critical status indicator being generated when the fuel consumption rate value is less than or equal to a first threshold, the cautionary status indicator being generated when the fuel consumption rate value is greater than the first threshold but less than or equal to a second threshold, and the normal status indicator being generated when the fuel consumption rate value is greater than both of the first threshold and the second threshold.

18. The machine of claim 14, wherein the controller is further configured to generate the provisional value at predefined intervals during the automated earth-moving operation, and wherein the status indicator is updated after each interval based on the provisional value.

19. The machine of claim 14, wherein the automated earth-moving operation comprises repeating cycles of the automated earth-moving operation, the controller being configured to apply the provisional value generated for a prior cycle as the provisional value for a subsequent cycle.

20. The machine of claim 14 further comprising one or more output devices having an operator interface, the one or more output devices configured to receive and communicate the status indicator to an operator of the machine via the operator interface.

* * * * *